United States Patent [19]

Carlo et al.

[11] Patent Number: 5,035,026

[45] Date of Patent: Jul. 30, 1991

[54] HINGE FOR PIECES OF FURNITURE

[75] Inventors: Gatti Carlo; Zetti Daniele, both of Modena, Italy

[73] Assignee: T.G.N. S.p.A., Italy

[21] Appl. No.: 550,994

[22] Filed: Jul. 11, 1990

[30] Foreign Application Priority Data

Jul. 28, 1989 [IT] Italy ..... 28961/89[U]

[51] Int. Cl.[5] ..... E05F 1/08

[52] U.S. Cl. ..... 16/288; 16/370; 16/302

[58] Field of Search ..... 16/237, 370, 302, 375, 16/288

[56] References Cited

U.S. PATENT DOCUMENTS

| | | | |
|---|---|---|---|
| 3,772,736 | 11/1973 | Hettich et al. | 16/288 |
| 4,736,491 | 4/1988 | Mertes | 16/370 X |
| 4,839,894 | 6/1989 | Lin | 16/302 X |
| 4,914,782 | 4/1990 | Rupprechter | 16/371 X |

*Primary Examiner*—Richard K. Seidel
*Assistant Examiner*—Patty E. Hong
*Attorney, Agent, or Firm*—Larson and Taylor

[57] ABSTRACT

The present invention provides a hinge consisting of two halves. Each half of the hinge comprises a base plate (5, 6), to be respectively fastened to a side (3) and a door (1) of a piece of furniture, a rocker arm (10, 14), and a link (7, 11). The intersecting rocker arms (10, 14) which are each provided in one half of the hinge, have a "V" profile in cross section, and are fitted the one into the other through an opening (26) formed in the cross-piece of the "V" profile of rocker arm (10). At an intersecting pivot point these rocker arms are pivotally connected to each other by means of pin (17), and at the facing ends of the base plates (5, 6), the rocker arms (14, 10) are each hingedly connected by means of a hinge pin (15, 16) with the base plate (5, 6) of the one half of the hinge. Through a link (7, 11) which by means of a respective pin (9, 13) is pivotally connected to the free end of the relative rocker arm (10, 14), each rocker arm is hingedly connected by means of a hinge pin (8, 12) with the opposite end of the base plate (5, 6) of the relative hinge half. The hinge is fitted with a spring (20) which acts between the lower and of line (7) and the free end of rocker arm (10). The base plates (5, 6) are provided respectively with one pair of bores (27) and two pairs of orthogonal slots (29, 30), and with one pair of bores (28) and one pair of slots (31) which are parallel to each other. By the slots (29, 30, 31) the plates (5, 6) can be vertically and horizontally adjusted in position.

5 Claims, 5 Drawing Sheets

HINGE FOR PIECES OF FURNITURE

FIELD OF THE INVENTION

The present invention relates to a hinge for pieces of furniture, particularly to a hinge made of metal, to be fastened by bases to respective parts of a piece of furniture, the piece of furniture being made of wood, plastic, or metal, and being adapted for domestic use, or for a use in offices, laboratories, workshops, factories, and the like.

STATE OF THE PRIOR ART

The prior art contemplates a hinge for a piece of furniture with one of the bases of the hinge being in the form of a cup-like shaped base which is hingedly connected with the lower ends of a rocker arm and a link. When assembled, the cup-like shaped hinge base is embedded and fastened in a suitable housing formed in a piece of furniture made of wood or of plastic. However, to make such a hinge requires the use of a precision drilling machine by a skilled workman and such may be not always at hand, particularly in industrially depressed regions or in countries not industrialized. Therefore, when such a cup-like shaped hinge base is provided, the assembly of the parts of a piece of furniture becomes rather difficult or even impossible, and the furniture is frequently damaged and must be discarded.

SUMMARY OF THE INVENTION

The present invention aims to improve the prior art by eliminating the aforementioned disadvantages, and to solve the technical problem of providing a hinge which will allow the parts of a piece of furniture, such as a side and a door thereof, to be assembled by an unskilled workman, without the need of any special tool or machine, but only by using a common screwdriver. Moreover, the hinge according to the invention, is connectable to a piece of furniture not only made of wood or plastic, as required by the prior art, but also of metal.

The technical problem is solved by the present invention with the provision of a hinge consisting of two hinge halves, each half of the hinge comprising a base which is to be fastened to a part of a piece of furniture, the hinge comprising also two intersecting rocker arms which, at facing ends of the bases, are each hingedly connected with the base of one hinge half. The rocker arms are pivotally connected to each other at an intersecting pivot point, each rocker arm being hingedly connected with the opposite end of the base of the other hinge half, through a link which is pivotally connected to the free end of the respective rocker arm, and is hingedly connected with the end of the base of the one hinge half, lying opposite to the end of the other hinge half, the hinge being fitted with a spring which is caused to act between the free end of one rocker arm and the respective link. The hinge is characterized in that each base is in the form of a plate with at least one pair of bores and at least one pair of slots.

The rocker arm and the link that are hingedly connected with the one hinge base plate fastened to a door of a piece of furniture, are both inwardly bent at a smaller angle than a right angle, at a point lying near to the connection with the hinge base plate, and are longer than the rocker arm and the link that are hingedly connected with the other hinge base plate fastened to a side of a piece of furniture. This is such that the door, when being moved into its opened position, may be allowed to override a closed contiguous door of a piece of furniture. The hinge base plate for a door of a piece of furniture, to which the relative rocker arm and link are hingedly connected, may be disposed at the door edge, or may be set at a distance therefrom ranging from 1 to 20 mm, such that the thickness of a piece of furniture may be accounted for. The length of the rocker arm and the link hingedly connected with the base plate fastened to a door of a piece of furniture, and the length of the rocker arm and the link hingedly connected with the base plate fastened to a side of a piece of furniture, are substantially equal.

By the present invention, a number of advantages are attained. The hinge is inexpensive, and is usable with pieces of furniture not only made of wood or of plastic material, but also of metal. The assembly of the parts of a piece of furniture is quick and easy, since by eliminating the cup-like shaped hinge base, a precise drilling by a skilled workman are not required for making the housing for such a cup-like shaped base. The base plates fastened to respective parts of a piece of furniture, such as a side and a door thereof, can each be exactly arranged in a selected position by finely adjusting the position of the screws threaded into a pair of slots provided in each respective base plate. Thus, the position of the hinge base plate for a door of a piece of furniture can be selected so as to account for the thickness of the respective piece of furniture, and so as to allow this door to override the closed contiguous door. Thanks to the provision in one of the intersecting rocker arms of an adjustable abutment screw, which may be caused to cooperate with a portion of the other rocker arm, a door can be swung into an open position to a maximum angle of between 90° to 170°.

DESCRIPTION OF THE PREFERRED EMBODIMENT

Figure 1:
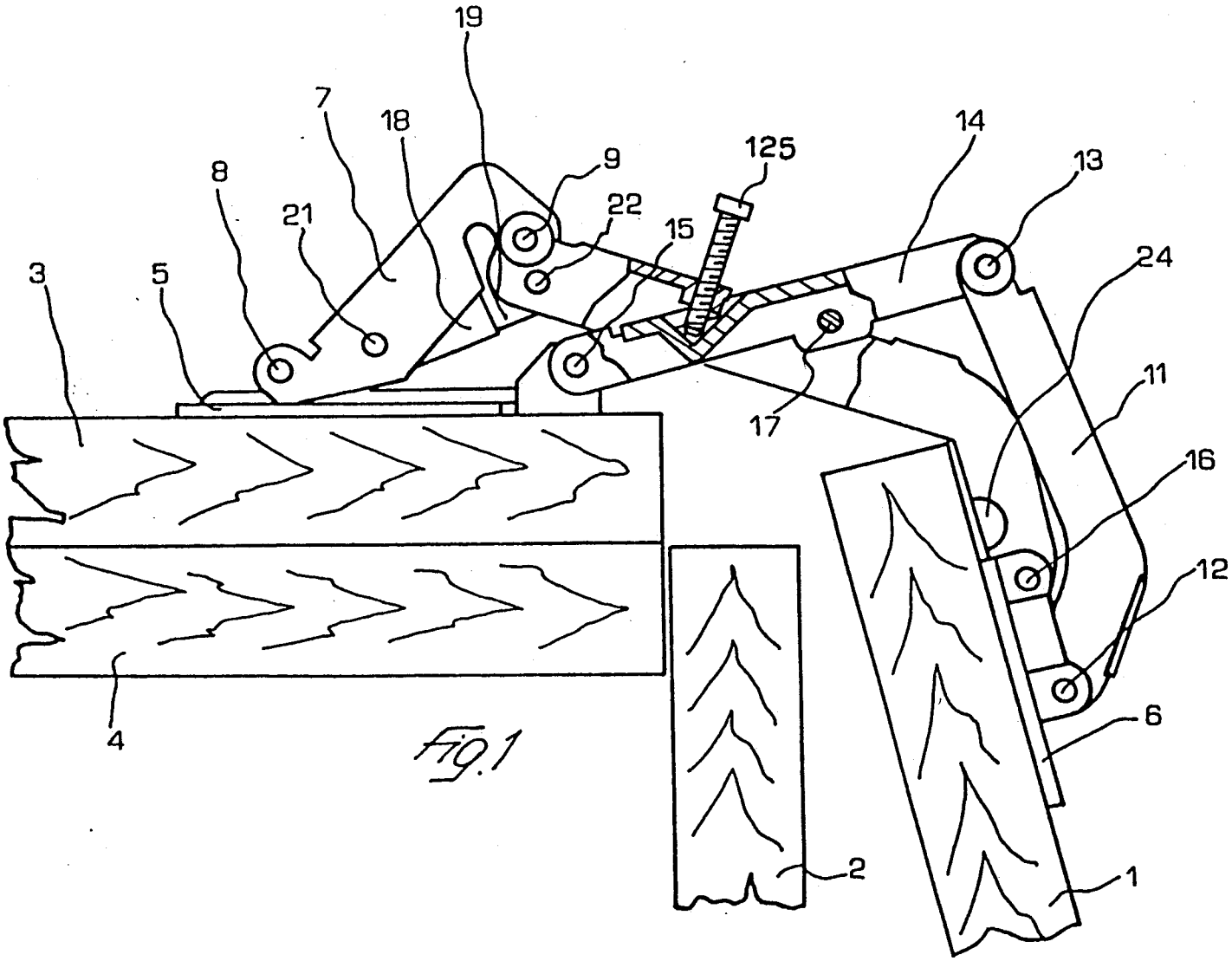
FIG. 1 is a side view of the hinge according to the invention, showing the hinge fully open and the abutment screw adjusted such that a door can be swung open at an angle up to 170°.

Referring to the drawings, the hinge as provided by the invention, consists of two halves. Each half of the hinge comprises a base that according to the invention, is in the form of a base plate 5, 6 to be fastened to a respective part of a piece of furniture, such as to the inner face of a side 3 and to the inside of a door 1 thereof. The hinge comprises also two intersecting rocker arms 10, 14, and two links 7, 11.

The intersecting rocker arms 10, 14 have a "V" profile in cross section, and are fitted, one into the other, through an aperture 26 provided in the crosspiece 25 of the rocker arm "V" profile. At facing ends of the hinge base plates 5, 6, the intersecting rocker arms 10, 14 are each hingedly connected, by means of a respective hinge pin 15, 16 with base plate 5, 6 of the one hinge half. At an intersecting pivot point, the rocker arms are pivotally connected to each other by means of a pivot pin 17. Each rocker arm is hingedly connected with the opposite end of the base plate of the other hinge half, through a link 7, 11 which by means of a pin 9, 13 is pivotally connected to the free end of the respective rocker arm, and by means of a respective hinge pin 8, 12 is hingedly connected with the end of the base plate of the one hinge half, laying opposite to the end of the other hinge half. Two pairs of recesses 23, 24 are formed in the wings of the "V" profile of the rocker arm 10, for the protruding ends of pins 21 and 22 to be received in the respective recesses 23, 24, when the hinge is moved into a contracted position.

An abutment screw 125 is provided in the rocker arm 10, for cooperation with a portion of the rocker arm 14. The abutment screw is adjustable so as to have a door swung into an open position up to 90°, or the same is adjusted, by being unthreaded, so that a door can be swung into an open position up to 170°. With the abutment screw being properly adjusted, a door can be swung to any chosen maximum angle between 90° and 170°. A suitable opening 32 is provided in the crosspiece of the "V" profile of the rocker arm 14 for the head of the said screw to be received therein, when the hinge is moved into its contracted position.

The hinge is fitted with a spring 20 which is caused to act between the lower end of link 7 and the free end of rocker arm 10. The spring 20 is housed in a casing 18 consisting of two telescoping halves, which is pivotally connected by means of a respective pin 21, 22 to the lower end of link 7 and to the free end of rocker arm 10. When the hinge is moved into the contracted position, the protruding ends of pins 21, 22 are each received in the relative pairs of recesses 23, 24 provided in the wings of the rocker arm 10 "V" profile.

The hinge is characterized in that base plates 5, 6 are provided with at least one pair of bores and at least one pair of slots. In this embodiment, the hinge base plate 5 is provided with one pair of bores 27 and with two pairs of slots 29, 30, and the hinge base plate 6 is provided with one pair of bores 28 and with one pair of slots 31. The slots 29 are parallel to the edge of the relative part of a piece of furniture, such as the side 3 thereof, and the slots 30 are perpendicular to the said edge. The bores 28 and the slots 31 are both parallel to the edge of the relative part of a piece of furniture, such as the door 1 thereof.

Figure 2:
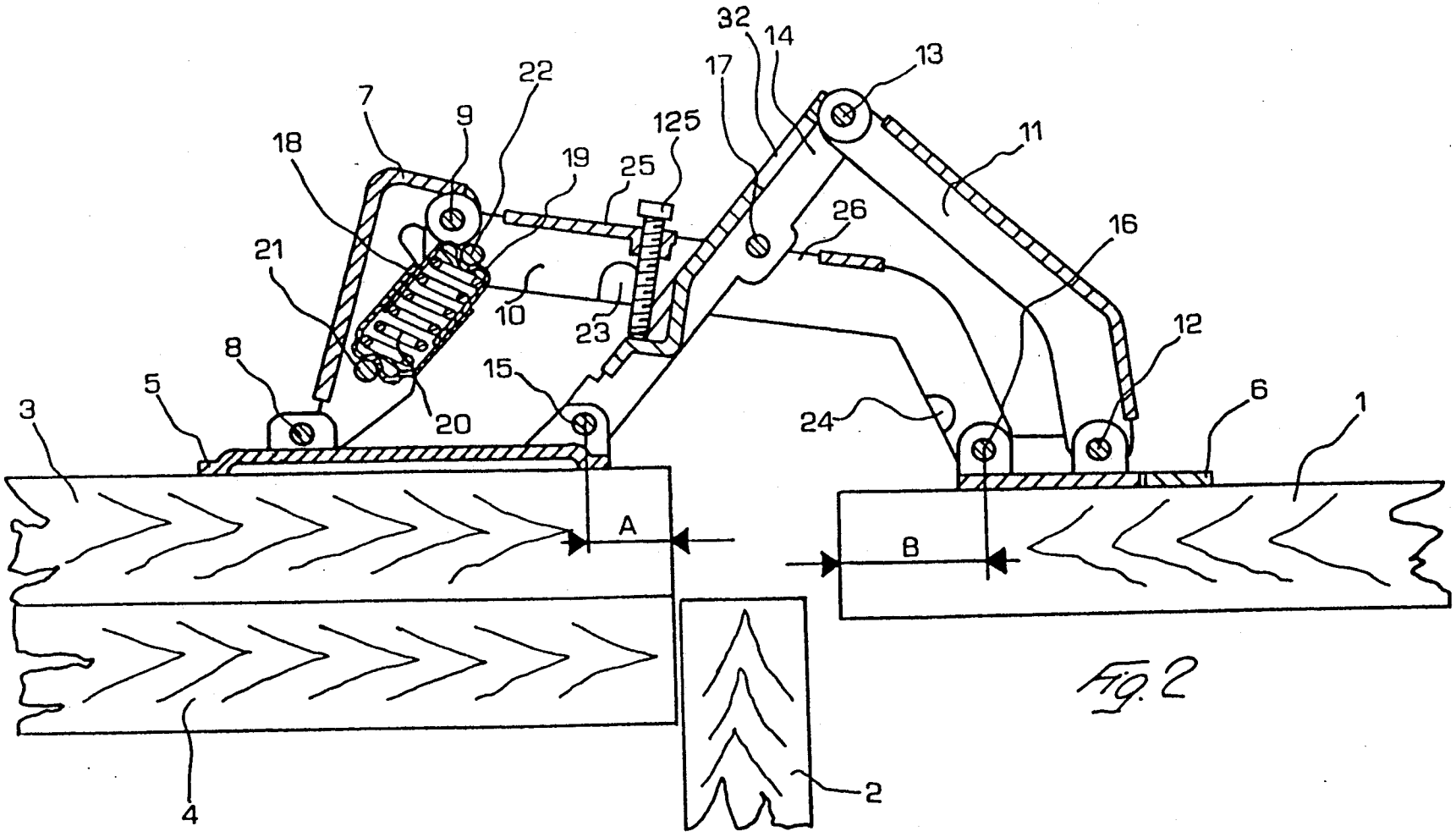
FIG. 2 is a side view of the hinge according to FIG. 1, showing the hinge partly open and the abutment screw adjusted such that the door can be swung open at an angle up to 90°.
Figure 3:
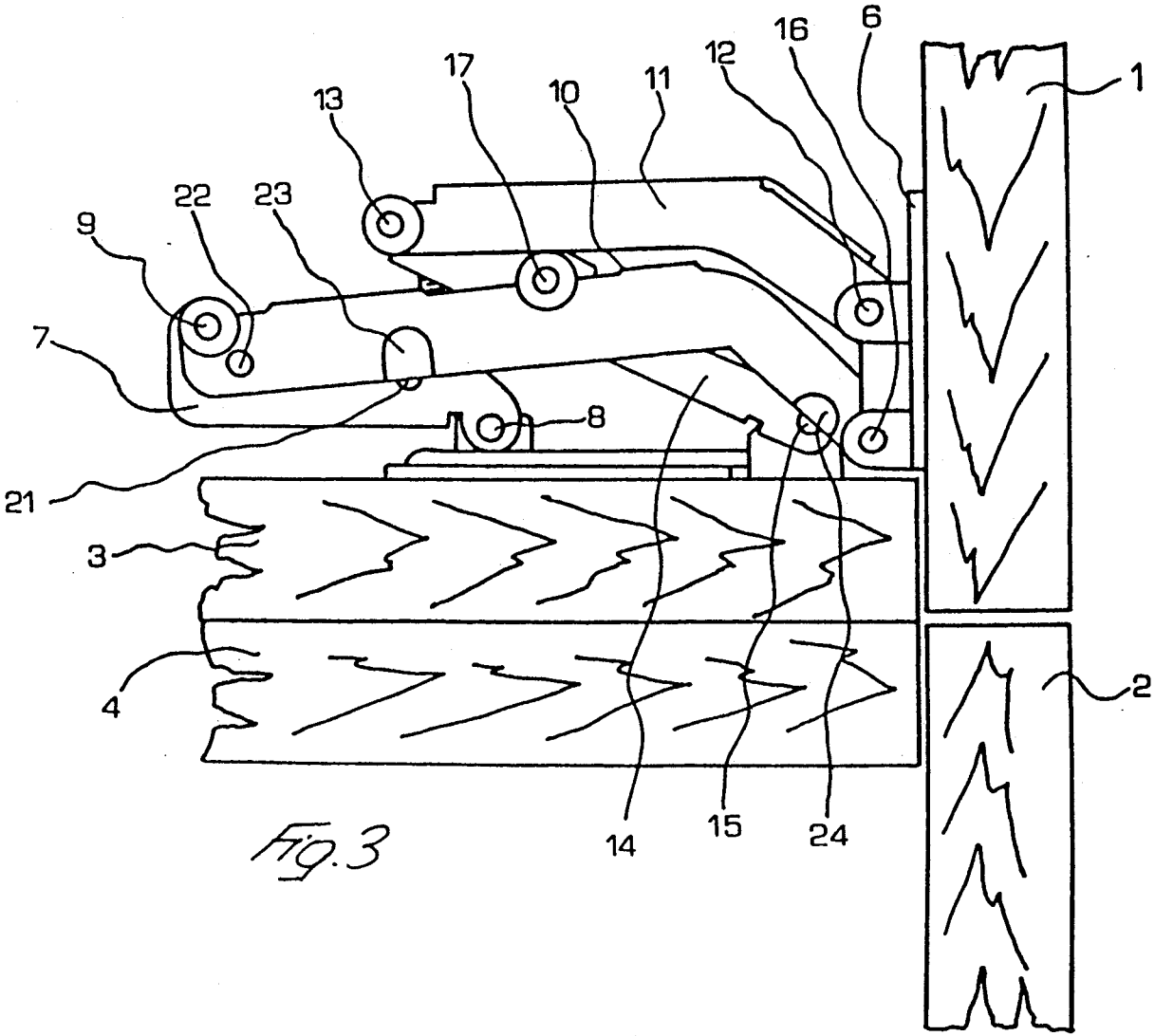
FIG. 3 is a side view of the hinge according to FIGS. 1 and 2, showing the hinge contracted.
Figure 4:
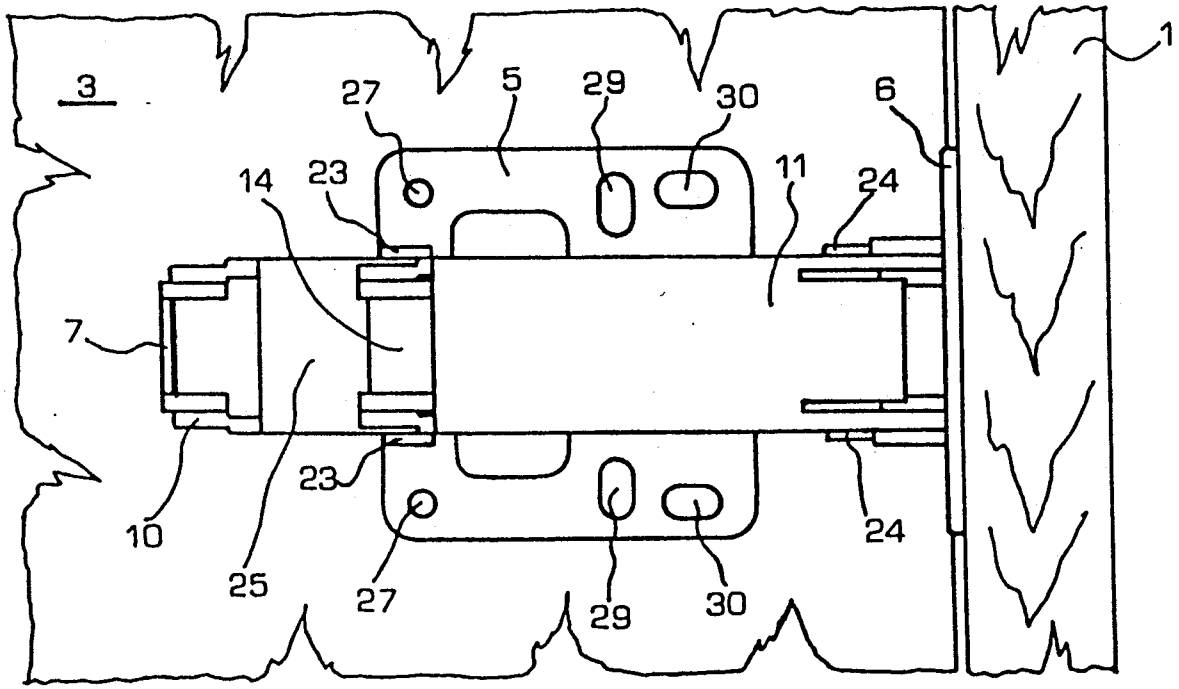
FIG. 4 is a top plan view of the contracted hinge shown in FIG. 3.
Figure 5:
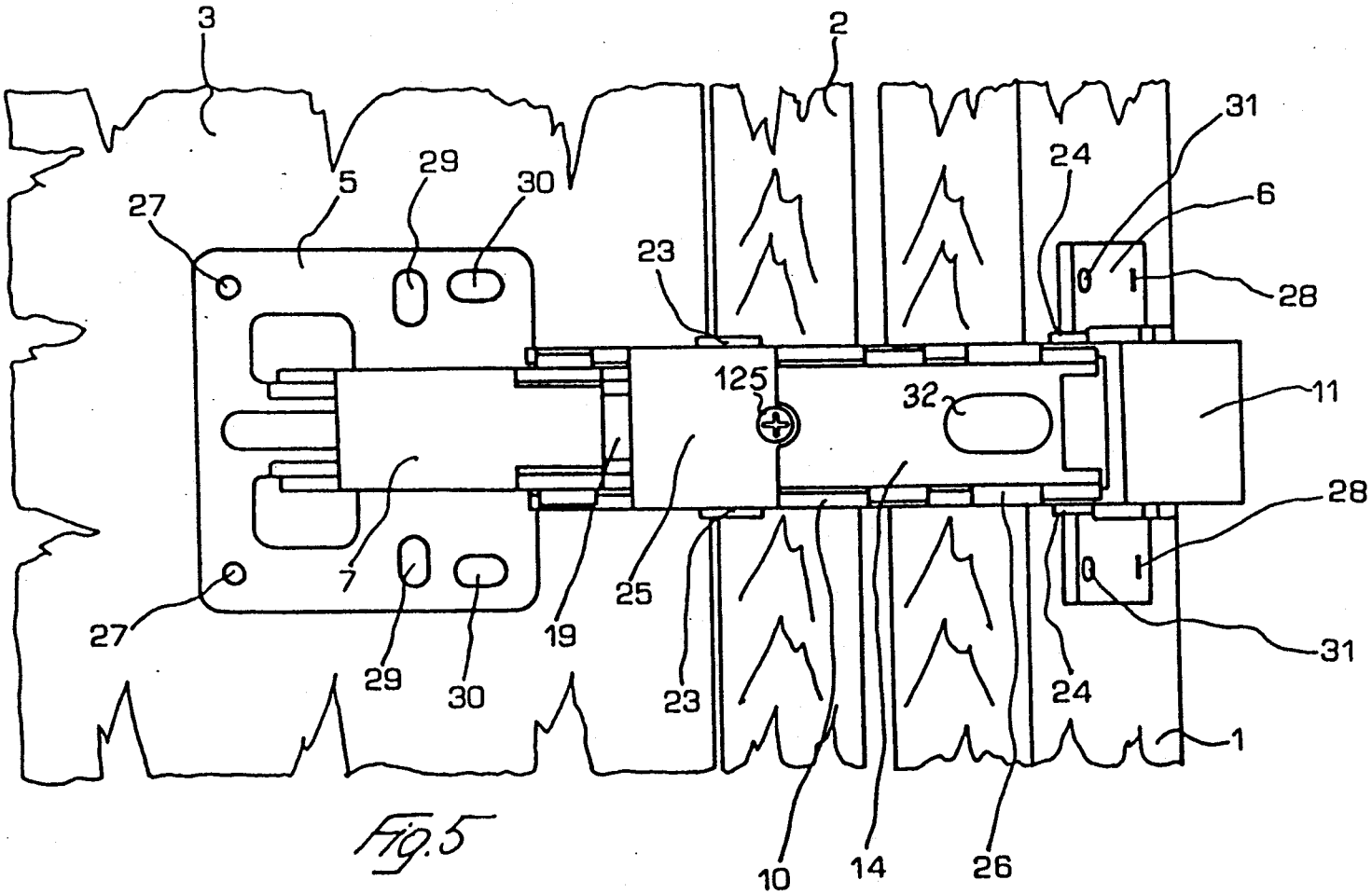
FIG. 5 is a top plan view of the fully open hinge shown in FIG. 2.

The base plates 5, 6 are arranged in a retracted position from the edge of the relative part of a piece of furniture. As shown in FIG. 2, the hinge base plate 5 is set at a distance A from the edge of side 3 of a piece of furniture, and the hinge base plate 6 is set at a distance B from the edge of door 1 of a piece of furniture. However, the hinge base plate 6 for a door of a piece of furniture may be adjacent to the door edge, or may be set at a distance therefrom ranging from 1 to 20 mm, such that the thickness of a side of a piece of furniture may be accounted for in the preferred manner.

Thanks to the provision of the pairs of slots 29, 30 in the hinge base plate 5, and of the pair of slots 31 in the hinge base plate 6, the base plates 5, 6 (to be secured by means of screws threaded into the respective bores 27, 28, and into the respective slots 29, 30, 31, to the inside of the respective part of a piece of furniture, such as to the inner face of side 3 and of door 1 thereof), can be vertically and horizontally arranged in the desired position by finely adjusting the position of the screws threaded into the respective slots 29, 30, and 31.

The procedure for assembling the parts of a piece of furniture is as follows.

First of all, a fitter shall ascertain that the distance A—between the pin 15 of the hinge base plate 5 for the side 3 of a piece of furniture and the front edge of side 3 corresponds to the desired predetermined value. This value should be such as to avoid, on one hand, that door 1 is prevented from closing—which would occur in the case of a higher value of A, and, on the other hand, that an excessive clearance is left between the front edge of side 3 and the inner face of door 1. Once the base plate 5 has been secured to the side 3 of a piece of furniture, by means of the screws threaded into the bores 27, and by means of the screws threaded into, and adjusted according to the selected position in the orthogonal slots 29, 30, the distance B between the pin 16 of the base plate 6 for the door 1 and the edge of door 1 is established. The distance B is chosen to allow the whole thickness of the front edge of side 3, or of only a portion of the edge, to be covered as preferred. If B is too large, the hingedly connected door 1 would be left in a locked condition. With the distance B having been established, the screws are first threaded into the slots 31 and are then adjusted according to the selected position in the slots 31, whereupon the screws are threaded into the bores 28, so that the hinge base plate 6 becomes fastened to the door 1 of a piece of furniture.

What is claimed is:

1. A hinge comprising first and second base plates, the first plate for fastening to a piece of furniture, the second plate for fastening to a door of the piece of furniture, such that the door is pivotable through an angle from a closed position of 0°, wherein the hinge is contracted, to a maximum pivot angle of up to 170°, wherein the hinge is open, the first and second base plates each including inner and outer ends, said hinge further comprising first and second intersecting rocker arms, the first arm being hingedly connected to the inner end of the first base plate, the second arm being hingedly connected to the inner end of the second base plate, the interlocking rocker arms being pivotably connected to each other at an intersecting pivot point, said hinge further comprising first and second links, the first link connecting a free end of the first rocker arm to the outer end of the second plate, the second link connecting a free end of the second rocker arm to the outer end of the first plate, said rocker arms and links being disposed within a plane perpendicular to both of said plates, the second link being fitted with a spring acting between the free end of the second rocker arm and the first base, the first and second base plates each including at least one pair of bores and at least one pair of slots for allowing the plates to be fastened with screws to the piece of furniture and the door of the piece of furniture, respectively, the first rocker arm being provided with an abutment screw for cooperation with a portion of the second rocker arm, the abutment screw cooperating with the second rocker arm to limit said maximum pivot angle of the door, the screw being adjustable to limit said maximum pivot angle to less 170° but greater then 90°, the second rocker arm including an opening for receiving an end of the abutment screw, the abutment screw being received in the opening while said hinge is disposed in said contracted position.

2. The hinge according to claim 1, wherein the first base plate is provided with one of pair of bores and with first and second pairs of slots, the first pair of slots being parallel to the plane of the rocker arms and links, the second pair of slots being perpendicular to the plane of the rocker arms and links.

3. The hinge according to claim 1, wherein the second base plate is provided with one of pair of bores and with one pair of slots, the slots being perpendicular to said plane.

4. The hinge according to claim 1, wherein the first plate is fastened to the piece of furniture with the inner end of the first plate being disposed a certain distance from an edge of the piece of furniture, the edge of the piece of furniture being perpendicular to the plane of the rocker arms and links, and wherein the second plate is fastened to the door of the piece of furniture with the inner end of the second plate being disposed a certain distance from an edge of the door of the piece of furniture, the edge of the door of the piece of furniture being perpendicular to the plane of the rocker arms and links and being parallel to the edge of the piece of furniture.

5. The hinge according to claim 1, wherein the rocker arms each have a "V"-shaped profile in cross-section, and wherein a portion of the first rocker arm, adjacent to the intersecting pivot point, is received by an aperture formed in a leg of the "V"-shaped second rocker arm.

* * * * *